US007311489B2

(12) United States Patent
Ekman

(10) Patent No.: US 7,311,489 B2
(45) Date of Patent: Dec. 25, 2007

(54) DEVICE FOR MOUNTING OF A TURNABLE IMPLEMENT

(75) Inventor: Tommy Ekman, Åmsele (SE)

(73) Assignee: Komatsu Forest AB, Umea (SE)

( * ) Notice: Subject to any disclaimer, the term of this patent is extended or adjusted under 35 U.S.C. 154(b) by 0 days.

(21) Appl. No.: 10/494,963

(22) PCT Filed: Nov. 21, 2002

(86) PCT No.: PCT/SE02/02117

§ 371 (c)(1),
(2), (4) Date: May 7, 2004

(87) PCT Pub. No.: WO03/057615

PCT Pub. Date: Jul. 17, 2003

(65) Prior Publication Data

US 2005/0017528 A1 Jan. 27, 2005

(30) Foreign Application Priority Data

Nov. 26, 2001 (SE) ..... 0103935

(51) Int. Cl.
*E02F 9/00* (2006.01)

(52) U.S. Cl. ..... 414/723; 37/468; 294/86.41; 403/348

(58) Field of Classification Search ..... 414/718, 414/729, 723, 918, 686, 680; 901/15, 29; 37/468; 403/348; 294/86.41
See application file for complete search history.

(56) References Cited

U.S. PATENT DOCUMENTS 3,413,029 A 11/1968 Donovan (Continued)

FOREIGN PATENT DOCUMENTS

DE 1 556 344 2/1970

(Continued)

OTHER PUBLICATIONS

Hultdins Inc, "Hultdins SuperSaw™—The most versatile tool in the industry. Any way you slice it. Grapple Saws", 4pgs, Apr. 1999.

(Continued)

*Primary Examiner*—Donald Underwood
(74) *Attorney, Agent, or Firm*—Nixon & Vanderhye P.C.

(57) ABSTRACT

A drive of mounting a rotating implement to a crane arm or similar, comprises a rotator located between the crane arm and the unit that at one end is pivot-mounted to the implement for rotating the same relative to the crane arm and slewing around a first pivot axis and at the other end is mounted to the crane arm via a hinged link for slewing around a second pivot axis, a swivel coupling arranged on the rotator for supplying the working chambers of a drive for the rotator and any other consumers included in the unit with a hydraulic medium and that to one end of the swivel coupling is arranged connecting unions, to which hydraulic medium lines leading from the crane arm are attached. For the flexible hydraulic lines between the crane and implement to be both well protected and cannot swing to and fro in an uncontrolled manner during the operational movement of the implement and/or crane arm, the hinged link between the crane arm and the rotator is designed as an open joint defined by two hinged points located at a distance from each other along the joint axis of pivot axis, that the connecting unions are arranged extending parallel to the first pivot axis and facing towards the second pivot axis, whereby the hydraulic medium lines connected to the connecting unions pass between the hinged points situated a distance from each other.

19 Claims, 6 Drawing Sheets

U.S. PATENT DOCUMENTS

Figure 1:
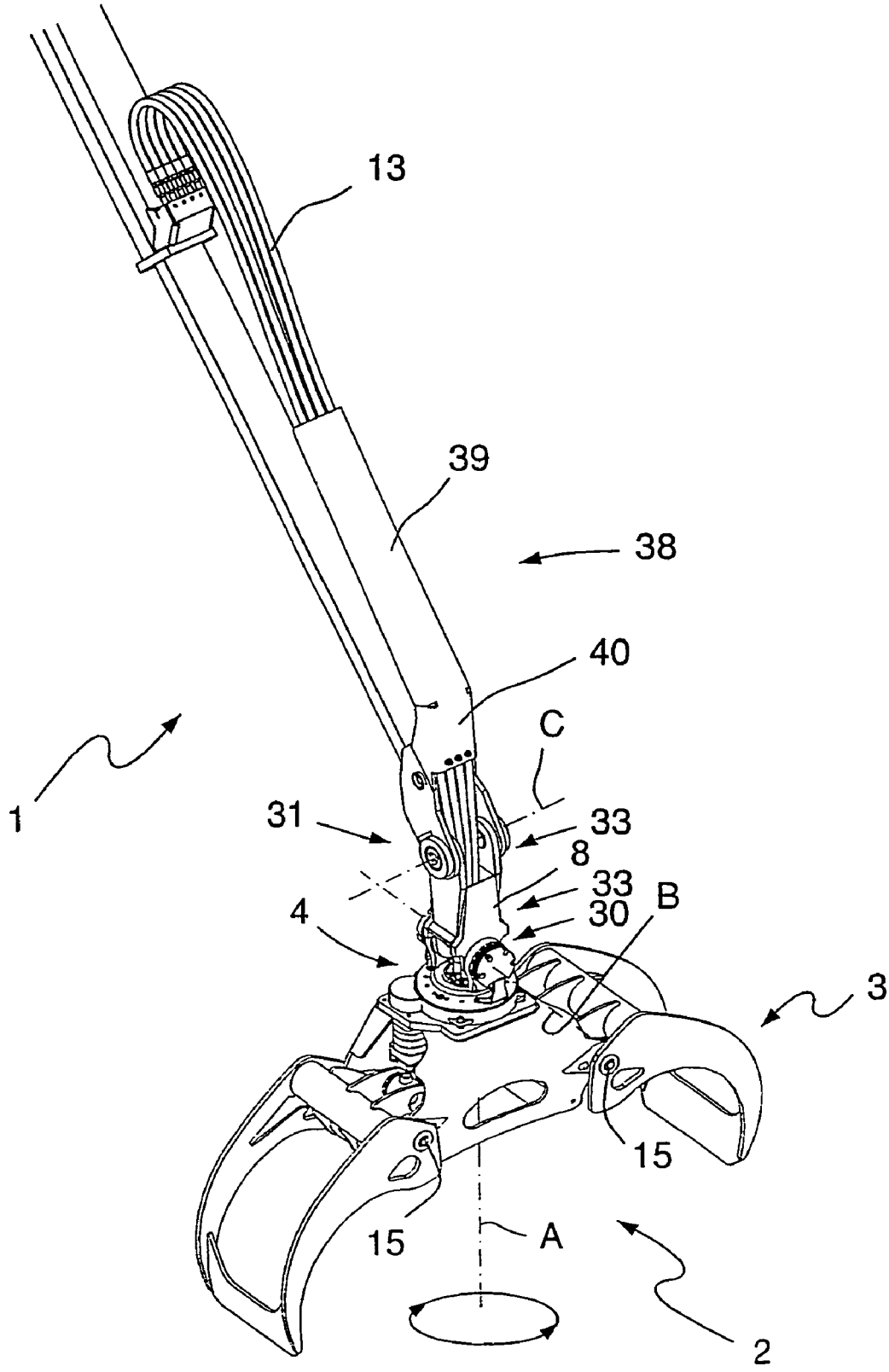

| | | | | |
|---|---|---|---|---|
| 3,759,564 | A * | 9/1973 | Seaberg | 294/88 |
| 3,933,389 | A | 1/1976 | Korbel | |
| 4,211,252 | A | 7/1980 | Pezzini et al. | |
| 4,333,676 | A | 6/1982 | Thumm | |
| 4,382,624 | A | 5/1983 | Lysenko | |
| 4,528,893 | A | 7/1985 | Neumann | |
| 4,576,406 | A | 3/1986 | Johnson et al. | |
| 4,685,349 | A * | 8/1987 | Wada et al. | 74/490.04 |
| 4,717,191 | A | 1/1988 | Farmer | |
| 4,989,652 | A | 2/1991 | Hansson | |
| 5,330,242 | A | 7/1994 | Lucky, Sr. | |
| 5,607,251 | A * | 3/1997 | Rafn | 403/348 |
| 5,632,625 | A | 5/1997 | Faust | |
| 5,908,060 | A | 6/1999 | Fargeot | |
| 6,530,742 | B2 * | 3/2003 | Trinler et al. | 414/718 |

FOREIGN PATENT DOCUMENTS

| | | |
|---|---|---|
| DE | 28 38 428 A1 | 3/1980 |
| DE | 31 35 150 | 1/1983 |
| DE | 31 32 489 A1 | 3/1983 |
| EP | 0 809 735 | 12/1997 |
| FR | 2 414 803 A | 8/1979 |
| WO | WO 99/37136 | 7/1999 |

OTHER PUBLICATIONS

Hultdin, Inc., "Hultdins SuperFell 850 Continuous Rotation", 2 pgs, 1999.

Papers from Opposition filed Apr. 15, 2004 in relation to corresponding European application, 17 pgs.

* cited by examiner

DEVICE FOR MOUNTING OF A TURNABLE IMPLEMENT

This application is a US national phase of international application PCT/SE02/02117 filed in Swedish on 21 Nov. 2002, which designated the U.S. PCT/SE02/02117 claims priority to SE Application No. 0103935-3 filed 26 Nov. 2001. The entire contents of these applications are incorporated herein by reference.

The present invention concerns structure for suspending a rotating implement, as well as a device for crane-mounted implements.

Crane-mounted rotatable implements such as tree processing units or log grapples are carried by a crane arm for rotating around a first pivot axis comprising the centre or main axis of the implement and at least one other pivot axis relative to the crane arm. This second pivot axis normally comprises one hinged link between the implement and the crane arm. To execute the said pivoting movement a round the first pivot axis, there is a rotator arranged between the implement and the crane arm. Using a swivel coupling in the rotator, a hydraulic medium can be transferred between the crane arm and a hydraulically acting driving means in the rotator and, where appropriate, also between the crane arm and other consumers included in the implement. The driving means in a conventional rotator consumer is served, i.e. supplied with and evacuated of a hydraulic medium, via lines comprising a set of flexible hoses, which, originating from the crane arm in the form of a bunch of hoses hanging outside and at a distance from the implement's hinged links with the crane arm, are attached to the top of the rotator via protruding angled unions. In the pivot pin contained in a rotator are arranged passages running axially, which are in fluidal connection with radial passages running through the wall of a housing surrounding the pivot pin. In known rotators and associated swivel couplings, the housing is the part that is linked to the end of the crane arm, while the pivoted pin in the housing is the part that is linked to the implement. For reasons that are easy to appreciate and mentioned in the foregoing, the connecting unions at the upper end of the rotator to which the pairs of hoses outgoing from the crane arm are connected will extend radially or at an angle from the outside of the swivel coupling's essentially cylinder-shaped housing. The connecting unions at the bottom of the rotator for the pairs of hoses outgoing from the rotator extend in the axial direction of the pivot pin straight down from its flat bottom or end face.

It should also be understood that the hydraulic lines connected to the connecting unions on the upper end of the rotator will for design reasons extend radially from the housing. By means of a certain degree of slackness or excess, the said hydraulic lines connected to the upper end of the rotator will bend away from the hinged link between the implement and the crane arm in so far as they will run clear of and be at such a distance from the said link connections that they will not risk being pinched during the operational movement of the implement. Meanwhile, hydraulic lines or hoses have tended to swing to and fro in an uncontrolled manner during the movement of the implement and sometimes come in contact with tree trunks, wooden stanchions or other objects in the vicinity of the implement and the working range of the crane arm, which can lead to hose failure or other similar damage. Should the occasion arise, not only must the implement undergo costly service with subsequent down-time and reduction in production of the forestry machine as a result but also the hydraulic oil that escapes after, for example, a hose failure will harm the environment.

One object of the present invention is therefore to achieve a means of suspension of an implement of the aforesaid type that does not exhibit the said disadvantages but is so constructed that the flexible hydraulic lines between the crane and the implement are well protected and cannot swing in an uncontrolled manner during the operational movement of the implement and/or crane arm.

A further object is to achieve a rotator that is designed so that the normally occurring radially protruding connecting unions on the top end of the rotator or its housing can be avoided and thereby the hydraulic lines extending between the crane arm and the implement can be positioned more centrally to the link connections between the implement and the crane arm.

A third object of the invention is to achieve a combination of units for crane-mounted rotatable implements whereby all the aforesaid problems have been eliminated.

This can be achieved with the distinctive features and characteristics specified in the following claims.

Figure 2:
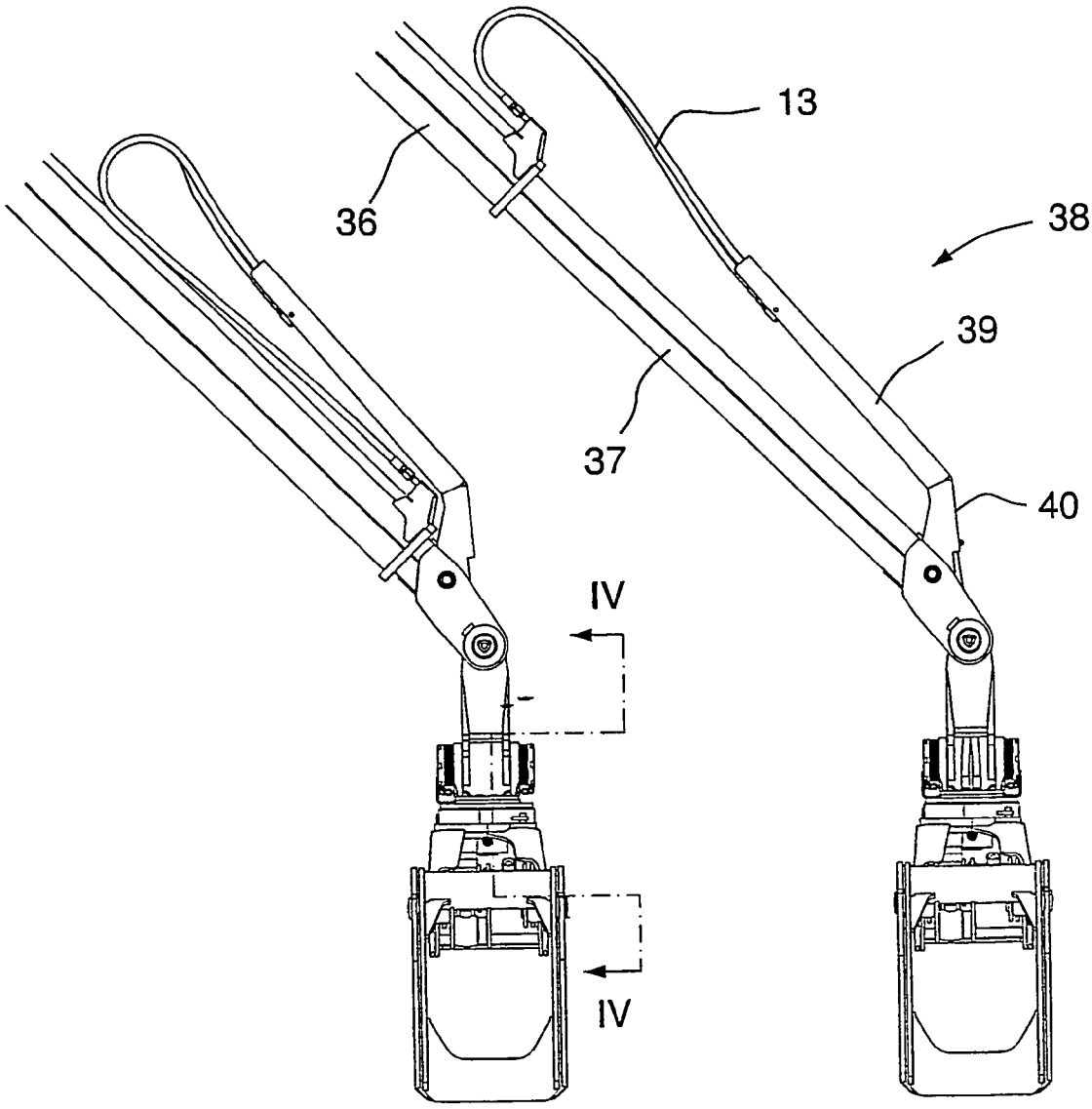
Figure 3:
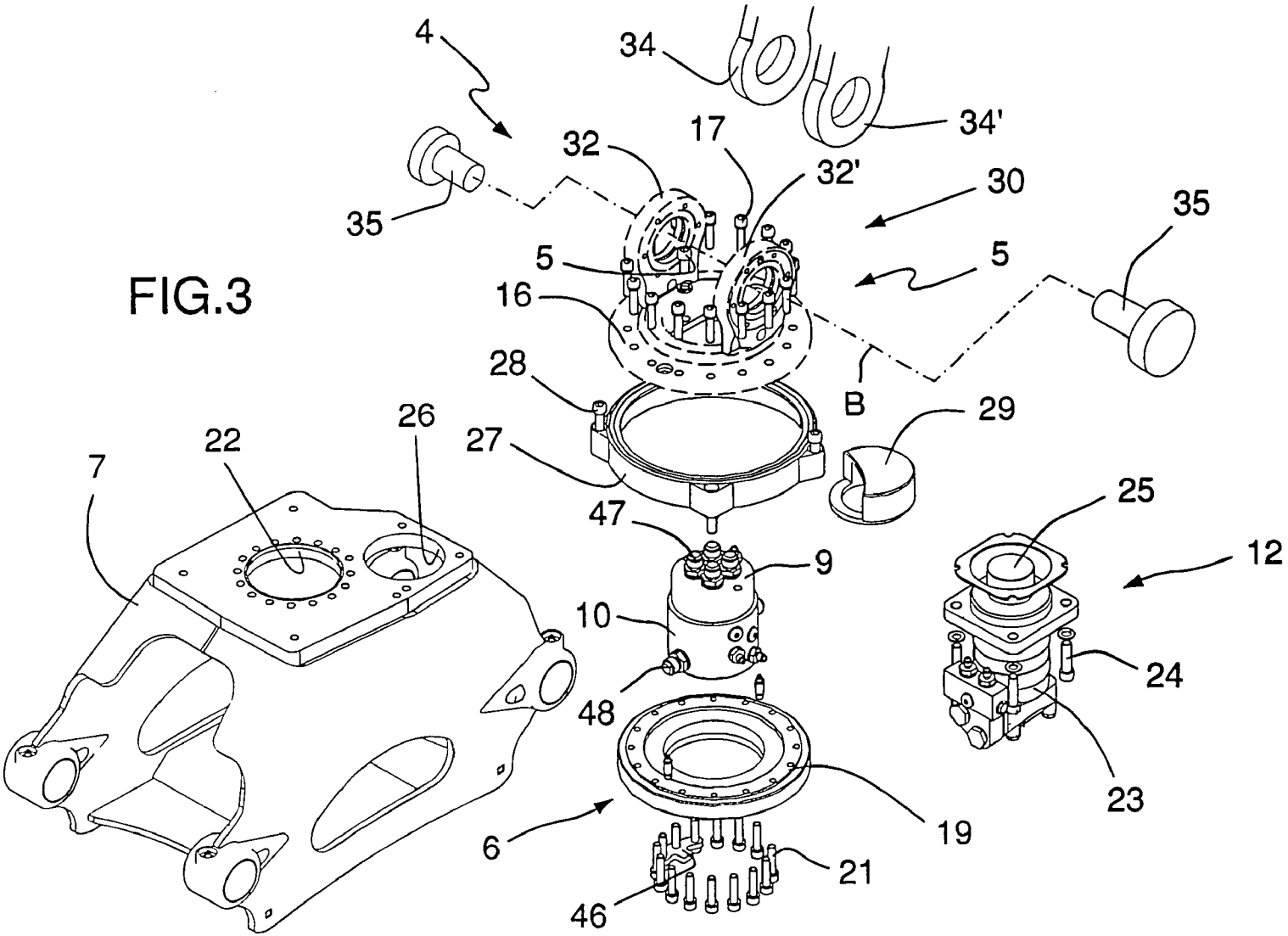
Figure 4:
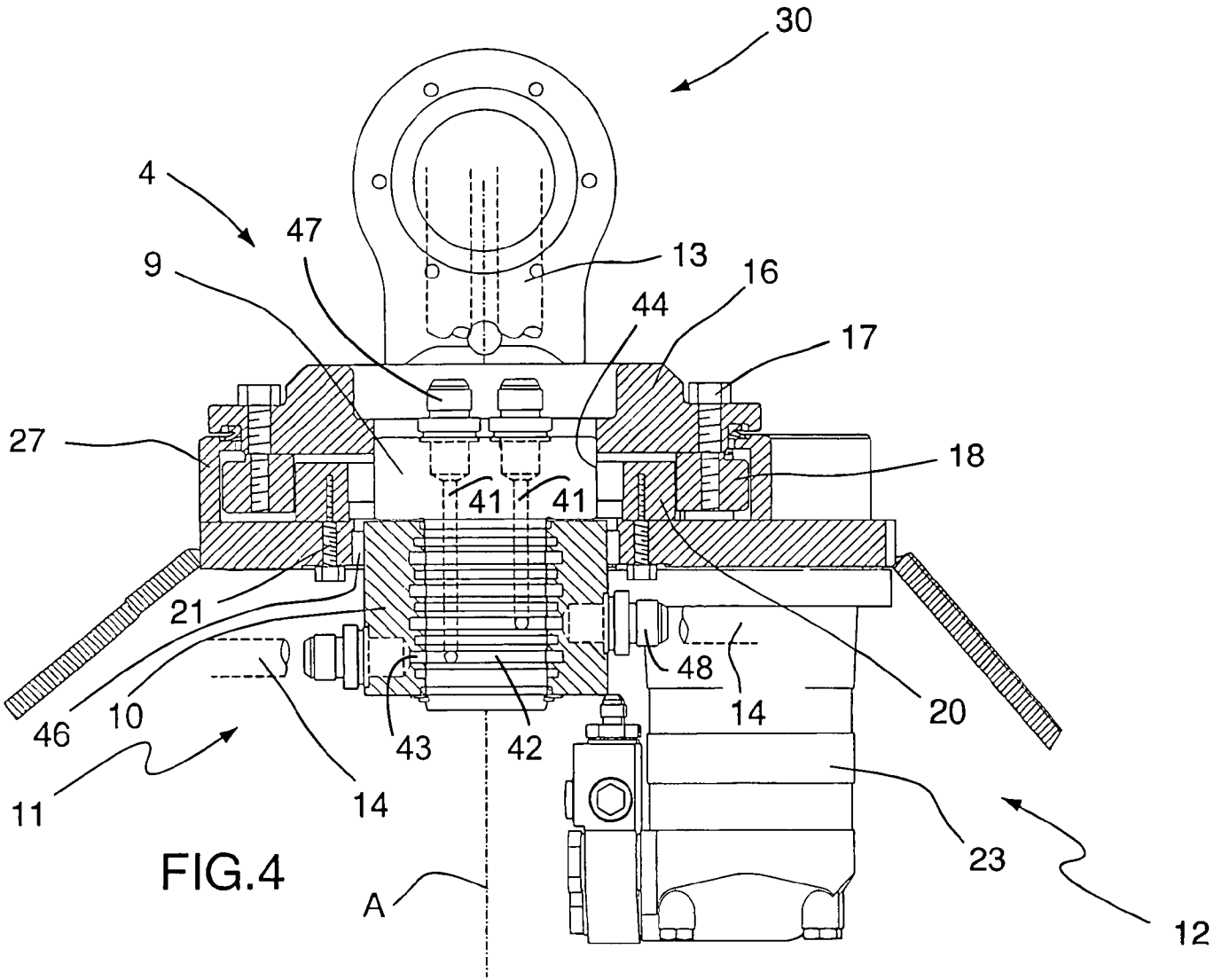
Figure 5:
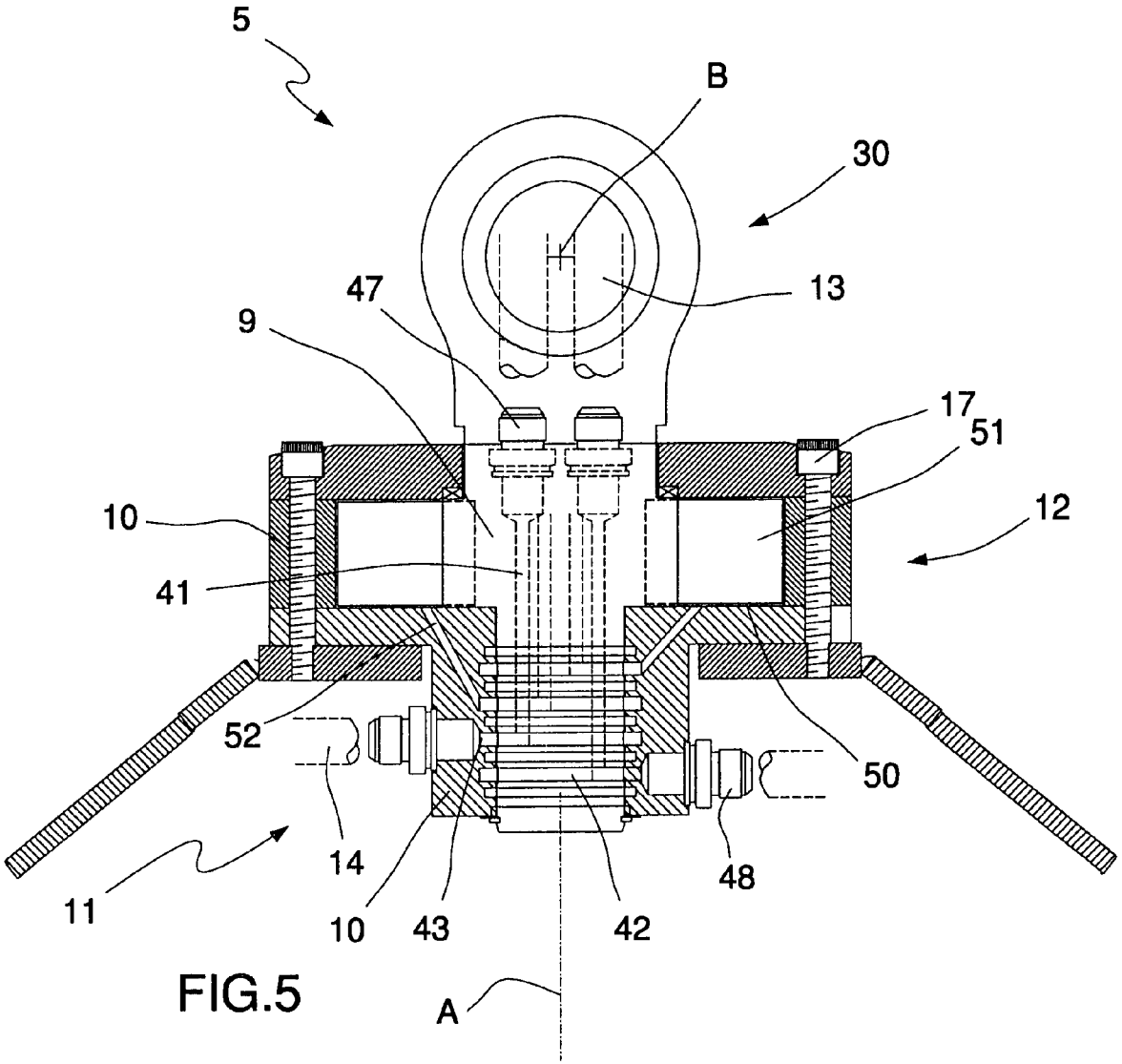
Figure 6:
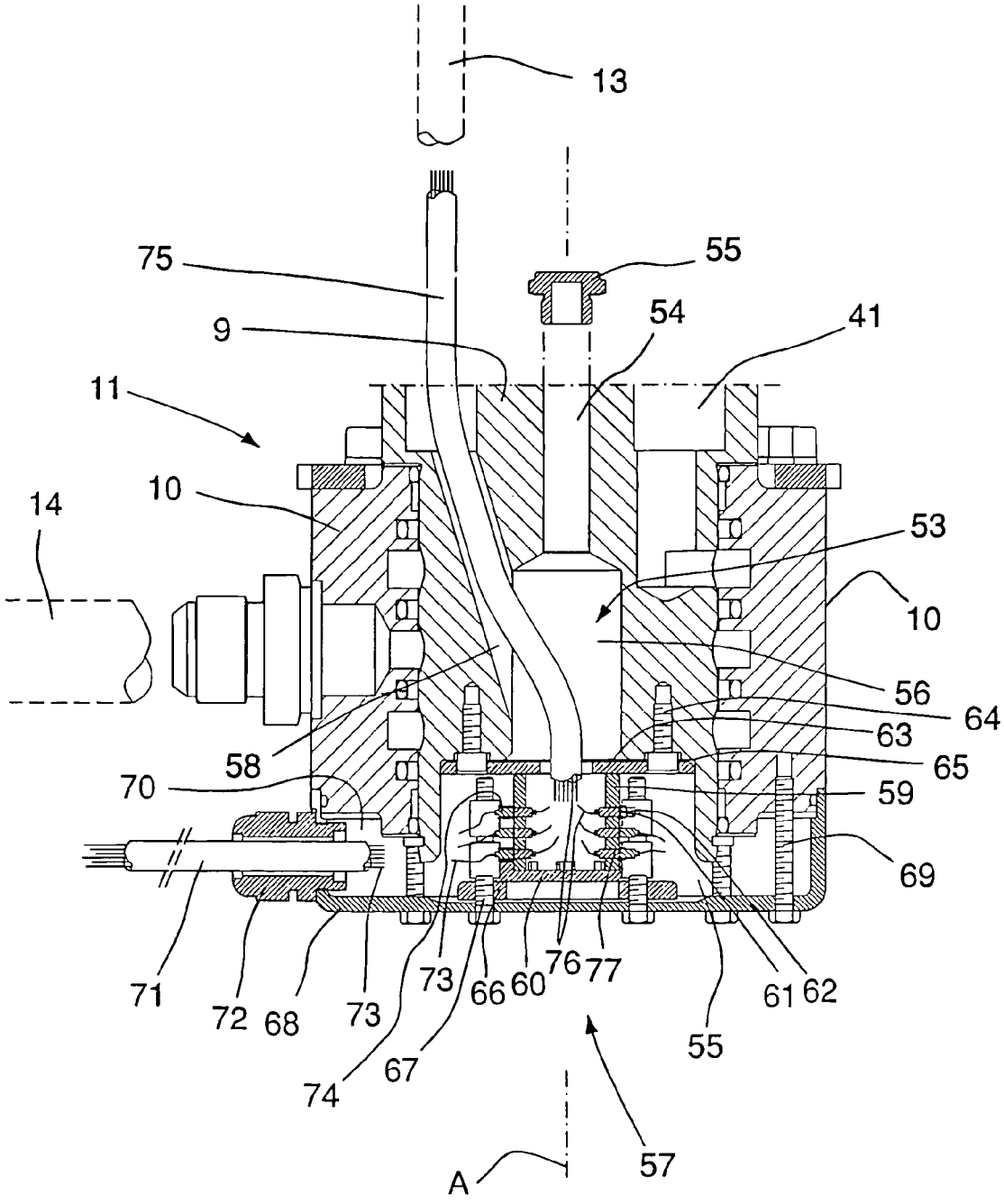

The following is a description of this invention with references to attached drawings, where FIG. 1 shows a perspective view of a crane-mounted tree processing unit according to the invention arranged on the free end of a telescopic crane arm, wherein the implement is equipped with a means of gripping the tree, FIG. 2 shows a side view of the tree processing unit shown in FIG. 1 with the telescopic crane arm contracted and extended respectively, FIG. 3 shows a view of part of the tree processing unit with disassembled parts, FIG. 4 shows a cross section of a rotator viewed along the line IV-IV in FIG. 2, FIG. 5 shows a cross section of a rotator in an alternative embodiment and FIG. 6 shows a cross section of a part of a rotator in a third alternative embodiment for combined swivelling of both hydraulic medium and electrical control signals.

In the figures, a crane arm is designated 1 and an implement, which in this case comprises an implement with a means of gripping the tree that can rotate relative to the crane arm is designated 2. The implement 2 is suspended from the free end of the crane arm via a rotator 4, one end of which is linked to the crane arm 1 with an attaching part 5 and the other end of which is rotatable via a pivot bearing 6 in the implement frame 7 for rotating around a first pivot axis A. The rotator 4 allows the implement to be rotated around the pivot axis A and thereby around its own axis as is illustrated with the arrow loop in FIG. 1. The crane arm also contains a link 8 at which the attaching part 5 is supported by the crane arm 1 via the said link for rotating the implement 2 around a first and a second relative each other perpendicular pivot axes B and C respectively. Through this mounting, the implement 2 is allowed to rotate cardanically in two different directions to the said pivot axis A.

Referring to FIGS. 3 and 4, the rotator 4 carries a swivel pin 9 that is pivot-mounted in a housing 10 fastened to the implement's frame 7 for rotating around the pivot axis A and which swivel pin forms part of a swivel coupling generally designated 11 for supplying (delivering and evacuating respectively) hydraulic medium to the operating chambers of a hydraulic means of driving 12 in the rotator 4 and supplying one or more additional consumers, among them piston-cylinder devices not shown in the figure, used for operating the unit's two means of gripping 3.

The rotation and centre axes of pivot bearing 6 and swivel pin 9 are coaxial with the first pivot axis A. The delivery and evacuation of hydraulic fluid to the rotator 4 and the additional consumers of the implement 2 is done through a first and second pair of flexible lines 13 that, originating from the crane arm 1 and extending downwards, are connected to one end of the rotator 4. From the other end of the rotator is a pair of lines 14 (in FIG. 4 only indicated with dashed lines) that are connected to the rotator's 4 means of driving 12 and other consumers respectively. The said flexible pair of lines 13 running along the crane arm are connected in a conventional way to a pump and tank respectively on a vehicle (not shown) that is carrying the crane arm in question. The aforesaid components comprising the rotator 4 and swivel coupling 11 are arranged to the frame 7 included in the implement 2.

Although this example of a mounting arrangement is illustrated and described for connection to a conventional grapple unit for trees, it should also be understood that the principle for the same nonetheless can be used in combination with any other type of crane-mounted implement such as a felling head with chain saw guide bar intended for a forestry machine or similar.

The unit's two means of gripping 3 are pivot mounted in a conventional manner with pins 15 arranged in the frame and each comprises a shank on each side of a line of symmetry through the stand coinciding with the centre axis A.

Referring to FIG. 3, the rotator 4 comprises an essentially circular upper part 16 that is fastened with bolts 17 to an outer gear ring 18 arranged on the periphery of a slew gear 19 included in the pivot bearing 6. The inner ring designated 20 for the said slew gear 19 rests on a plane against the centre axis A at right angles to the top of the frame 7 and by means of bolts 21 is fixed to the frame so that the slew bearing's hollow centre concentrically coincides with a hole 22 in the frame. The means of driving 12 comprises a hydraulic motor 23, which via bolts 24 is fastened to the frame 7 in such a way that its geared 25 drive shaft extends through a second hole 26 in the frame 7 and is mesh with the outer gear ring 18 of the slew bearing in order to turn it and thereby also turn the frame 7 or implement 2 in different directions around the first pivot axis A. On the essentially flat top of the frame 7 is a principally circular housing 27 covering the outer gear ring that is fastened with bolts 28 to the said top of the frame. In a similar way, an open-bottomed cover 29 is arranged on the hydraulic motor 23 gear wheel 25 and is clamped between the cover 27 and the flat top of the frame 7.

As illustrated in FIG. 4, the rotator's circular upper part 16 as well as the free ends of the crane arm 1 are equipped with a forked part 30 and 31 respectively, where each such forked part principally comprises a pair of fork shanks 32, 32' at a distance from each other and parallel with the centre axis A, each defining a hinge point. The fork shanks are located relative to each other in such a way that they between them contain a space between the pivot centre of the relatively hinged parts. The link 8 extending between the crane arm 1 and the rotator 2 is similarly equipped at its ends with a forked part 33 and associated fork shanks 34, 34' located a distance from each other, which, as should be illustrated by the figures, is located in the space formed in the forked parts 30, 31 of the crane arm and rotator respectively. The hinged link between each such forked part, located in each other, one in the other, comprises a pair of opposing pins 35, 35' that hinge together the respective adjacent fork shanks of the meeting forked parts. The said opposing pair of pins 35, 35' are of a length that has been chosen to extend through both on each side of each hinge meeting fork shanks 32, 32' and 34, 34' respectively without encroaching to any greater degree the space formed between the fork shanks. As the hinge points are separate and positioned at a distance from each other along the pivot axis (B) hinge pin line, a type of open hinge construction is obtained that is both light weight and offers a substantial and broad crane tip with associated broad hinges for secure connection of implements to the crane arm.

The link 8 is designed as a hollow beam or box and therefore exhibits an axial hole running through it, whereby, as illustrated in the figures, the respective pairs of lines 13 leading from the crane arm extend through the relative pivot centres B and C respectively of the hinged parts 1, 2, 8, via the inner cavity of the link. Through the resulting open design of the hinged links, the pairs of hydraulic lines 13 extending between the crane arm 1 and the unit 2 can be placed in close proximity to the pivot axis A and in principle so that the pairs of lines cut the axis. Extending through the pivot centres B, C of the relative hinged parts and the link 8 cavity respectively, the flexible hydraulic lines are both well protected during the movement of the unit and connected to the rotator in close proximity of the pivot axis A and in principle arranged in a circle around the said first pivot axis A. By this arrangement, the hydraulic lines are exerted to only minimal strain from bending and twisting movements also in the case where the implement 2 is operated between its endmost positions.

In this illustrated embodiment, the crane arm 1 is of telescopic type comprising two telescopically interposed boom-like parts 36, 37. FIG. 2 shows the telescopic crane arm in contracted and extended position respectively. To prevent the hydraulic lines 13 running along the outside of the crane arm from swinging to and fro in an uncontrolled manner and possibly thereby also being damaged through entanglement, stretching or friction during the telescopic movement of the crane arm, there is a means of guiding generally designated 38 arranged on the free end of the crane arm 1. The means of guiding 38 comprises a rigid channel-shaped arm 39, one end of which is fastened to the transitional area between the forked part's 31 join to the crane arm and is located parallel to the outer section of the crane arm 1 at a distance from its upper side. As illustrated in FIG. 2, the longitudinal concave inside of the rigid arm 39 facing the crane arm contains the pairs of hydraulic lines 13 extending between the crane arm 1 and the unit 2, whereby the pairs of lines are arranged against the inside of the arm and are secured to the arm during the relative movements of the boom-like parts. In order to provide a smooth transition of the pair of lines 13 between the means of guiding 38 and the hollow interior of the link 8 during the relative movements of the boom-like parts, the rigid arm, in the area of its joining with the crane arm 1, is equipped with a part 40 that is angled downwards towards the crane arm and via outward extensions on both sides of the downward angled part is rigidly joined to the end of the crane arm.

Referring to FIG. 4, a swivel coupling 11 is obtained in a conventional manner in that the swivel pin 9 is pivot-mounted in the housing designated 10 by means of suitable bearings and seals. For supplying the rotator 4 means of driving 12 with hydraulic medium, passages in the form of a set of axially drilled holes 41 extend through the swivel pin 9. These drilled holes open into respective groove-shaped peripheral passages 42 in the hole wall of the housing and continue via radial passages 43 out through the wall of the housing 10. The swivel pin 9 exhibits at one end a thicker part 44 that is mounted in the cavity located in the inner ring 20 of the centre of the slew bearing 19. The upper end of the swivel pin 9 in the form of the thicker part 44 is fastened to the rotator's circular upper part 16 with bolts. The swivel coupling housing 10 is joined to the frame 7 via a cross-slotted union 46 so that the swivel pin and the housing can be moved axially in the slew bearing's 19 inner ring 20 for fitting.

Unlike conventional rotators 4 in which the housing 10 is normally joined to the crane arm 1 and is fitted with unions protruding radially towards the pivot axis A for connecting the pairs of lines 13 coming from the crane arm, and the swivel pin 9 can be joined to the implement 2 and is fitted with unions protruding downwards parallel with the pivot axis A for connecting the pair of lines 14 coming from the rotator, the present rotator 4 is so designed that it can be mounted in the corresponding way or in the opposite direction. That is to say, that the swivel pin 9 can be joined to the crane arm 1 via the rotator's 4 attaching part 5 and the housing 10 can be joined to the implement's frame 7. As best illustrated in FIG. 1, this offers the advantage that the connecting unions 47 located on the end of the swivel pin 9 and extending parallel with the centre axis are arranged in a circle in the centre of the slew bearing 19 and face upwards towards a plane that is parallel with the second pivot axis B and to which plane the first pivot axis A, in which the implement 2 in this case via the link 8 is suspended from the crane arm, at a normal angle. The connecting unions 48 for the pairs of lines 14 coming from the lower end of the rotator are directed radially out from the circular outer of the housing 10.

FIG. 5 shows the rotator in an alternative embodiment and comprises herein a swivel pin 9 supported by the attachment part 5 of the rotator and a housing 10 that can be joined to the frame of the implement and in which the swivel pin is pivot-mounted through suitable bearings and seals. The attachment part 5 can be pivot-mounted to the crane arm via a joint for slewing around a pivot axis B. In the area of a cavity or a space 50, the swivel pin exhibits a thicker part in which, in a conventional and well-known manner are arranged two spring-loaded flaps or vanes that divide the space into two sub- or working chambers. These parts consequently form the means of driving the rotator 12, which here constitutes an integral part of the rotator. Connecting unions 47 are provided for connecting a pair of lines coming from the crane arm 1, and a first pair of axially drilled holes or passages 41 are provided in the swivel pin 9, each one of which opens into a swivel coupling 11 comprising a set of circular cavities 42 located at different levels in the housing and into two of which cavities the said drilled holes open. The cavities are connected via radial passages 43 to the connecting unions 48 that, protruding radially from the peripheral outer of the housing, are intended for connecting hydraulic medium lines 14 and thereby supplying other consumers included in the implement such as the illustrated piston-cylinder means used to operate the unit's means of gripping 3. Dashed lines illustrate a second pair of axial passages 41 that also open into two circular cavities 42 in the swivel coupling. For supplying the rotator 4, the said respective circular cavities 42 are connected to respective working chambers in the housing via respective channels 52 extending diagonally through the housing. As the flexible and with dashed lines indicated hydraulic lines 13 leading from the crane arm 1 to the rotator 4 can be connected to the rotator axially relative to the first pivot axis A they can be located more centrally in the middle of the hinged links between the implement 2 and the crane arm 1.

FIG. 6 shows the present rotator in an embodiment where it not only offers an elegant routing of the lines used to convey a hydraulic medium from the crane arm 1 to the implement 2 carried at its end but also allows electric and data signals to be conveyed between the implement and a control system for it that is located in the vehicle carrying the crane arm (not shown in the figures).

FIG. 6 shows a longitudinal section through part of the lower end of the rotator 4 that is facing the implement 2. As illustrated in FIG. 6, there is a circular cylindrical cavity generally designated 53 in the lower end of the swivel pin 9 centre. In a direction parallel with the centre or pivot axis A extends a drilled hole 54 that at its top end terminates in an opening fitted with an air filter 55. The cavity 53 is two spaces arranged axially in succession in the form of an outer space 55 and an inner space 56 of which the outer space is diametrically somewhat larger then the inner space and contains a swivel and slip-ring unit generally designated 57 for conveying electrical signals between the implement and the control system. As described earlier, reference number 41 designates the axial drillings that are used to convey a hydraulic driving medium via a swivel coupling 11 to a consumer, such as the means of driving 12 the rotator 4. A closer study of FIG. 6 will clearly reveal that a passage 58 is arranged extending diagonally between one of these axial drillings 41 and the inner space 56.

The swivel and slip-ring unit 57 comprises a stator 59 and a rotor 60 with a number of inter-rotating contact paths of ring-shaped tracks 61 with slip rings 62 running in them. The stator 59 comprises a flange ring upper part 63 fastened with bolts 64 to a flat 65 shoulder made in the transition between the outer and the inner chambers 55, 56. The rotor 60 comprises a flange ring lower part 66 fastened with bolts 67 to a casing 68 used to cover the end of the swivel pin 9. The said casing 68 is in turn detachably mounted with bolts 69 to the rotator 4 housing 10. The casing 68 has an opening 70 through which a strand 71 of a cable from the implement 2 extends and to which opening the strand is secured with a means of load relief 72. The individual conductors 73 in the said strand 71 of the cable are in contact with the connecting or contact points 74 of the rotator part 60.

One interesting distinctive feature of the present invention is that one of the axial drillings 41, which is normally used to supply a consumer with hydraulic medium via a swivel coupling 11, in combination with the diagonally arranged passage 58 is used as a lead-through for a strand 75 of a cable from the crane arm 1. To be precise, the strand 75 forms part of the wiring that is in connection with the control system for the implement that is situated in the vehicle carrying the crane arm 1. The individual conductors 75 of the cable are in contact with the connecting or contact points 77 of the stator 59.

In order to both protect the wiring from chafing and to make the cables exhibit characteristics that are essentially comparable to the hydraulic-conveying lines, the hydraulic lines are utilised as through passages for the wiring, whereby such a line can be suitably connected to one of the protruding connecting unions 47. Contrary to known technology in which the cables are arranged hanging in bunches so as to go clear of the link connection between the top of the crane and the implement, a uniform and very elegant routing of the hydraulic lines and wiring through the centre of the hinge connection is obtained hereby.

The present invention is not limited to the above description or as illustrated in the drawings but can be changed and modified in a number of different ways within the framework of the idea of invention specified in the following claims.

The invention claimed is:

1. A device to mount a rotating implement to a crane arm, comprising:

a rotator locatable between the crane arm and the implement that at one end is pivot-mounted to the implement for rotating the same relative to the crane arm and slewing around a first pivot axis and at the other end is mountable to the crane arm via a hinged link for slewing around a second pivot axis, a swivel coupling arranged on the rotator for supplying the working chambers of a drive for the rotator with a hydraulic medium;

one or more connecting unions provided to one end of the said swivel coupling, said connecting unions being provided with hydraulic medium lines leading from the crane arm, wherein:

the hinged link between the crane arm and the rotator is designed as an open joint defined by two hinged points located at a distance from each other along the joint axis of the second pivot axis, the connecting unions are arranged extending parallel to the first pivot axis and facing towards the second pivot axis, whereby the hydraulic medium lines connected to the connecting unions pass between said hinged points located at a distance from each other, the crane arm is of the extendable telescopic type comprising two telescopic boom-like parts mounted one inside the other, a guide for the lines is arrangable on the free end of the crane arm between which guide and the crane arm the lines are arrangable during the relative movement of the boom-like parts, and the guide comprises a rigid arm, one end of which is fastenable at the hinged link on the free end of the crane arm and which arm, locatable parallel with the outer section of the crane arm and a distance from its upper side, exhibits an inside to face the crane arm against which the lines are brought and fixed.

2. A device according to claim 1, in which the connecting unions are distributed in a circle around pivot axis.

3. A device according to claim 1, in which the hinged link to the crane arm comprises an intermediate hollow link to which one end of the rotator is hinged for slewing around the second pivot axis and the other end of which link is hinged to the crane arm for slewing the unit around a third pivot axis relative the crane arm, in which also the third axis is also designed as an open joint defined by two hinge points located a distance from each other along its joint axis.

4. A device according to claim 3, whereby the hydraulic medium lines connected to the connecting unions run through a link cavity passing between the hinge points for both the second and the third pivot axes and respectively located a distance from each other along the joint axis.

5. A device according to claim 3, whereby the first and the second pivot axis respectively are located at an angle to each other so that the unit is allowed to slew cardanically in different directions.

6. A device according to claim 3, whereby each open joint is formed by two interlocking forked parts, one in the other, the hinged fork shanks of which form the hinge points located a distance from each other.

7. A rotator intended to be applied between a crane arm and an implement for rotating the implement around a first pivot axis relative to the crane arm, said rotator comprising an attaching part that can be pivot-mounted to the crane arm via a joint for slewing the implement around a second pivot axis, the attaching part carrying a swivel pin that for slewing around the first pivot axis is pivot-mounted in a housing that can be joined to the implement, the swivel pin containing parallel and in the direction of the first pivot axis running hydraulic medium passages that open into circular cavities of a swivel coupling included in the housing and in which housing are arranged passages for a hydraulic medium for supplying the working chambers of a drive for rotating the implement relative to the attaching pail, whereby the passages extend diagonally through the part of the housing, and whereby the swivel pin exhibits an end face facing the second pivot axis on which are arranged a set of protruding connecting unions for hydraulic medium lines which connecting unions are oriented coaxially with the first pivot axis.

8. A rotator according to claim 7, whereby for slewing the implement around the first pivot axis the attaching part comprises a circular hub or bearing that is pivot-mounted and can be joined to the implement frame.

9. A rotator according to claim 8, whereby the circular bearing in its mounted position at least partially surrounds the swivel pin.

10. A rotator according to claim 7, whereby the housing has a set of unions protruding radially towards the first pivot axis between which hydraulic motor hydraulic medium lines are meant to extend.

11. A rotator according to claim 7, whereby the drive comprises a chamber or space arranged in the housing where the swivel pin can be rotated relative to the housing by at least one vane or flap acting in the chamber that divides the chamber into two sub- or working chambers and wherein the said chambers are supplied with hydraulic medium via the passages arranged in the housing.

12. A rotator intended to be applied between a crane arm and an implement for rotating the implement around a first pivot axis relative to the crane arm, said rotator comprising an attaching part that can be pivot-mounted to the crane arm via a joint for slewing the implement around a second pivot axis, the attaching part carrying a swivel pin that for slewing around the first pivot axis is pivot-mounted in a housing that can be joined to the implement, the swivel pin containing parallel and in the direction of the first pivot axis running hydraulic medium passages that open into circular cavities of a swivel coupling included in the housing and in which housing are arranged passages for a hydraulic medium for supplying the working chambers of a drive for rotating the implement relative to the attaching part, whereby the passages extend diagonally through the part of the housing, wherein the rotator further comprises a swivel and slip-ring unit for conveying electrical signals between the implement and a control system via the crane arm that exhibits a stator joined to the swivel pin and a rotor joined to the housing.

13. A rotator according to claim 12, whereby the swivel and slip-ring unit is enclosed in a space arranged in the end of the swivel pin.

14. A rotator intended to be applied between a crane arm and an implement for rotating the implement around a first pivot axis relative to the crane arm, said rotator comprising:

an attaching part that can be pivot-mounted to the crane arm via a joint for slewing the implement around a second pivot axis, the attaching part carrying a swivel pin that is pivot-mounted in a housing that can be joined to the implement, the swivel pin containing hydraulic medium passages parallel to the first pivot axis that open into circular cavities of a swivel coupling included in the housing and in which housing are arranged passages for a hydraulic medium for supplying the working chambers of a drive for rotating the implement relative to the attaching part; and a swivel and slip-ring unit for conveying electrical signals between the implement and a control system via the crane arm that exhibits a stator joined to the swivel pin and a rotor joined to the housing, wherein a passage is arranged extending between one of the swivel pin hydraulic medium passages and the inner space and a strand of the electrical wiring exits the crane arm and extends through said hydraulic medium passages and the passage, respectively.

15. A rotator according to claim 14, in which the electrical lead is contained in a hydraulic line connected to a connecting union.

16. A unit for crane-mounted rotatable implements comprising:

a rotator locatable between the crane arm and the implement that at one end is pivot-mounted to the implement for rotating the same relative to the crane arm and slewing around a first pivot axis and at the other end is mountable to the crane arm via a hinged link for slewing around a second pivot axis;

a swivel coupling arranged on the rotator for supplying the working chambers of a drive for the rotator with a hydraulic medium;

one or more connecting unions provided to one end of the swivel coupling, said connecting unions being provided with hydraulic medium lines leading from the crane arm, wherein:

the hinged link between the crane arm and the rotator is designed as an open joint defined by two hinged points located at a distance from each other along the joint axis of the second pivot axis, the connecting unions are arranged extending parallel to the first pivot axis and facing towards the second pivot axis, whereby the hydraulic medium lines connected to the connecting unions pass between the said hinged points located a distance from each other, the crane arm is of the extendable telescopic type comprising two telescopic boom-like parts mounted one inside the other, the rotator comprises an attaching part connectable to the crane arm via a pivot joint that carries a swivel pin that for slewing around the first axis of rotation is pivot-mounted to a housing joined to the implement, and the swivel pin includes parallel hydraulic medium passages running in the direction of the first axis of rotation and opening into circular cavities of the swivel coupling included in the housing and to which housing are arranged passages for supplying the working chambers for a drive for rotating the implement relative to the attaching part, whereby the passages extend diagonally through part of the housing and the swivel pin exhibits an end face facing the second pivot axis on which are arranged a set of protruding connecting unions; and a guide for the lines arrangable on the free end of the crane arm between which guide and the crane arm the lines are arrangable during the relative movement of the boom-like parts, wherein the guide comprises a rigid arm, one end of which is fastenable at the hinged link on the free end of the crane arm and which arm, locatable parallel with the outer section of the crane arm and a distance from its upper side, exhibits an inside to face the crane arm against which the lines are brought and fixed.

17. A unit according to claim 16, further comprising a swivel and slip-ring unit for conveying electrical signals between the implement and a control system via the crane arm that exhibits a stator joined to the swivel pin and a rotor joined to the housing.

18. A unit according to claim 17, wherein a passage is arranged extending between one of the swivel pin hydraulic medium passages and the inner space and a strand of the electrical wiring exits the crane arm and extends through said hydraulic medium passages and the passage, respectively.

19. A unit according to claim 18, in which the electrical lead is contained in a hydraulic line connected to one of the connecting unions.

* * * * *